US006351222B1

(12) United States Patent
Swan et al.

(10) Patent No.: US 6,351,222 B1
(45) Date of Patent: Feb. 26, 2002

(54) METHOD AND APPARATUS FOR RECEIVING AN INPUT BY AN ENTERTAINMENT DEVICE

(75) Inventors: Philip L. Swan, Richmond Hill; William T. Henry, Whitby, both of (CA)

(73) Assignee: ATI International SRL, Christ Church (BB)

( * ) Notice: Subject to any disclaimer, the term of this patent is extended or adjusted under 35 U.S.C. 154(b) by 0 days.

(21) Appl. No.: 09/183,880

(22) Filed: Oct. 30, 1998

(51) Int. Cl.[7] ..... G08C 19/00

(52) U.S. Cl. ..... 340/825.72; 345/156; 345/157; 345/158; 380/252; 381/73.1; 348/77

(58) Field of Search ..... 345/156, 327, 345/358, 326, 157, 158; 348/77, 171; 380/252; 381/73.1, 96, 71.1; 340/825.72; 367/197, 198, 199

(56) References Cited

U.S. PATENT DOCUMENTS 4,319,088 A * 3/1982 Orfield ..... 381/73.1
4,988,981 A * 1/1991 Zimmerman et al. ..... 345/156
5,197,098 A * 3/1993 Drapeau ..... 380/252
5,594,469 A * 1/1997 Freeman et al. ..... 345/327
6,002,808 A * 12/1999 Freeman ..... 345/145
6,072,494 A * 6/2000 Nguyen ..... 345/358
6,111,580 A * 8/2000 Kazama et al. ..... 345/358

* cited by examiner

*Primary Examiner*—Brian Zimmerman
*Assistant Examiner*—Yves Dalencourt
(74) *Attorney, Agent, or Firm*—Vedder, Price, Kaufman & Kammholz

(57) ABSTRACT

A method and apparatus for processing acoustic and/or gesture input commands by an entertainment device begins by detecting an acoustic initiation command and/or a gesture initiation command. The initiation command may be directed to a particular entertainment device, which may be a part of an entertainment center, or to the entire entertainment center. In addition, the initiation command corresponds to a particular operation of the entertainment device. Having detected the initiation command, the process proceeds by detecting an acoustic function command and/or a gesture function command, which is associated with the detected initiation command. The flnction command indicates the particular change desired for a corresponding parameter. Having detected the function command, it is interpreted to produce a signal for adjusting the parameter of the entertainment device.

18 Claims, 3 Drawing Sheets

METHOD AND APPARATUS FOR RECEIVING AN INPUT BY AN ENTERTAINMENT DEVICE

TECHNICAL FIELD OF THE INVENTION

This invention relates generally to the input command processing and more particularly to acoustic and/or gesture input command processing.

BACKGROUND OF THE INVENTION

Entertainment devices such as computers, televisions, DVD players, video cassette recorders, stereos, amplifiers, radios, satellite receivers, cable boxes, etc., include user input processing devices to receive inputs from users to adjust and/or control certain operations of the entertainment device. For example, a computer has a mouse and a keyboard for receiving user inputs that are subsequently processed by the central processing unit. In addition, the computer may include voice recognition software and a microphone to receive audio or speech input commands and, via the voice recognition software, processes the input commands in a similar fashion as it processes commands from a mouse or keyboard.

Other entertainment devices, such as televisions, receivers, and VCRs, receive input commands via a wireless remote control, which transmits digital signals via an infrared transmission path. The infrared transmission path uses a particular form of modulation such as amplitude shift keying, slow infrared or fast infrared. An alternative wireless input command device would use radio frequency transmissions wherein the signals are modulated via amplitude modulation and/or frequency modulation. Upon receiving the wireless command, the entertainment device processes the command to execute it.

User command devices, (e.g., a mouse, a keyboard, a wireless remote control) utilize a manufactured predefined set of commands to evoke a particular response from the entertainment device. For example, when a particular button is pressed on a remote controller, a predefined digital code is generated and transmitted to the entertainment device. As such, the user has little flexibility in customizing the command input with a corresponding function. Voice recognition provides a user more flexibility in customizing inputs to the entertainment device to perform particular functions. For example, a user may train the voice recognition software to recognize a particular vocal command to initiate a desired function.

Advances have been made with respect to input command devices, especially for a handicap user. In particular, input devices have been developed to recognize eye movements to evoke a particular command. As such, a user may focus his or her eyes on a particular portion of the screen wherein a visual receiving device tracks the eye movement to determine the particular screen location being focused on. Having made this determination, the input device functions as any other input device in providing commands to the central processing unit.

While voice recognition and certain eye movement tracking techniques have provided flexibility in providing input commands to entertainment devices, combinations of such audio and visual inputs have not been produced. Therefore, a need exists for a method and apparatus for providing acoustic and/or gesture inputs to an entertainment device.

DETAILED DESCRIPTION OF A PREFERRED EMBODIMENT

Generally, the present invention provides a method and apparatus for processing acoustic and/or gesture input commands by an entertainment device. Such processing begins by detecting an acoustic initiation command and/or a gesture initiation command. The initiation command may be directed to a particular entertainment device, which may be a part of an entertainment center, or to the entire entertainment center. In addition, the initiation command corresponds to a particular operation of the entertainment device. For example, if the entertainment device is a television set, the initiation command, which may be an acoustic initiation command, gesture initiation command, or a combination thereof, relates to volume, picture, favorite channel setup, channel changing, etc. As another example, if the entertainment device is a VCR, the initiation command corresponds to playing a video tape, recording a program, etc. Having detected the initiation command, the process proceeds by detecting an acoustic function command and/or a gesture function command, which is associated with the detected initiation command. The function command indicates the particular change desired for the corresponding parameter. For example, if the entertainment device is a television, and the initiation command was regarding volume, the function command would include one of volume up, volume down, mute, etc. Having detected the function command, it is interpreted to produce a signal for adjusting a parameter of the entertainment device. With such a method and apparatus, acoustics and/or gesture inputs may be provided to an entertainment device to evoke parameter changes and/or operational functions.

Figure 1:
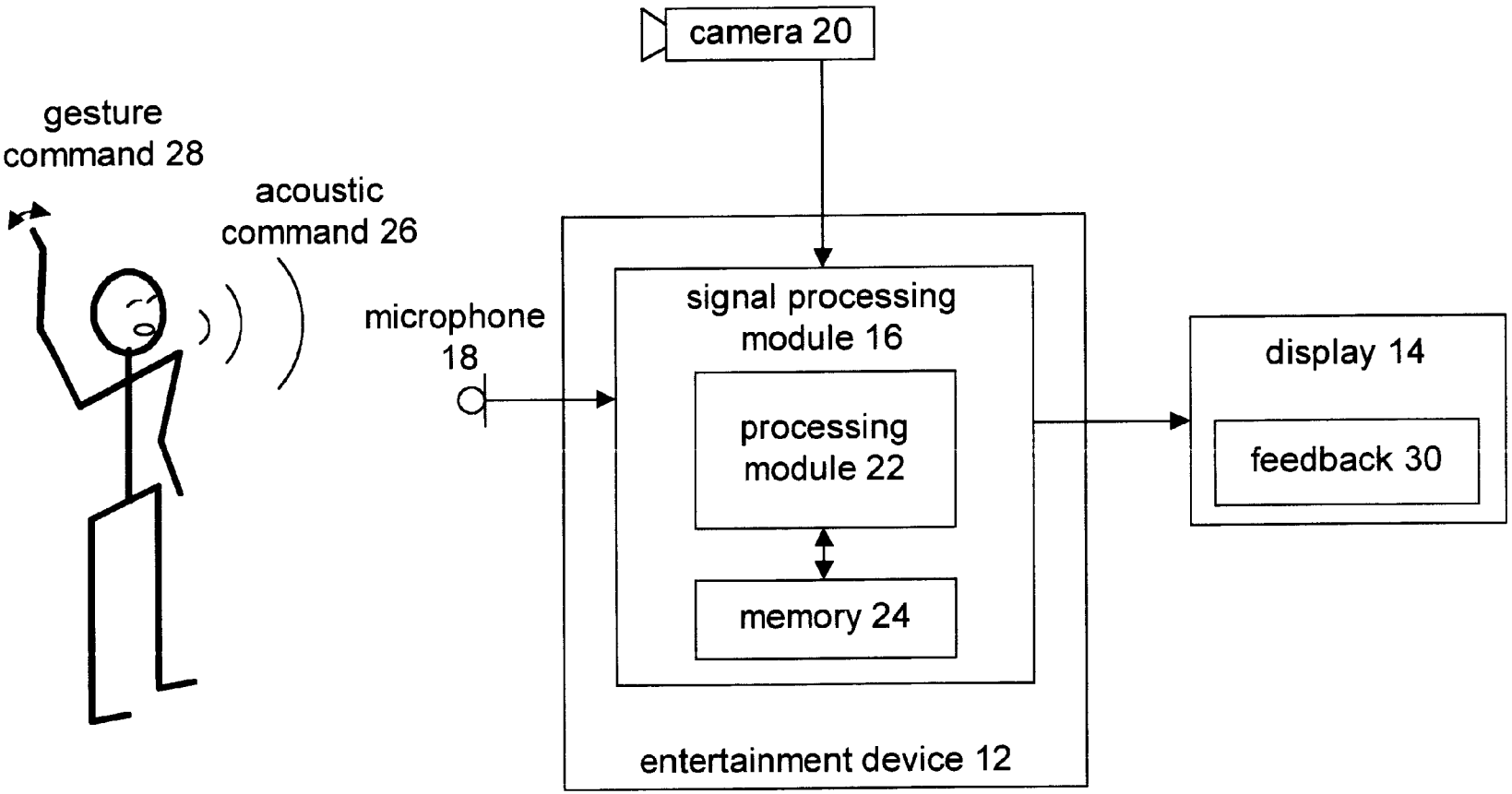
FIG. 1 illustrates a schematic block diagram of an entertainment device in accordance with the present invention.

The present invention can be more fully described with reference to FIGS. 1 through 3. FIG. 1 illustrates a schematic block diagram of an entertainment area 10 that includes an entertainment device 12, display 14 and a user. The entertainment device 12 which may be a television, computer, VCR, DVD, stereo, radio, and/or any device that provides a video and/or audio output, includes a signal processing module 16. The signal processing module 16 is operably coupled to receive video inputs from camera 20 and acoustic inputs from microphone 18. The signal processing module 16 further includes a processing module 22 and memory 24. The processing module 22 may be a single processing entity or a plurality of processing entities. Such a processing entity may be a microprocessor, microcomputer, microcontroller, digital signal processor, central processing unit, state machine, logic circuitry, and/or any other device that manipulates digital data based on operational instructions. The memory 24 may be a single memory device or a plurality of memory devices. Such a memory device may be a random access memory, read-only memory, floppy disk memory, system memory, hard disk memory, magnetic tape memory, and/or any device that stores operational instructions. Note that if the processing module 22 includes a state machine or logic circuitry to perform one or more of its functions, the memory that stores the corresponding operational instructions is embedded within the circuitry comprising the state machine and/or logic circuitry. The operational instructions stored in memory 24 and executed by processing module 22 will be described in greater detail with reference to FIGS. 2 and 3.

The user provides an acoustic command 26 and/or gesture command 28 to the entertainment device. For example, acoustic command 26 may be vocalized commands, clapping hands, stomping feet, and/or any acoustic noise made by a human and/or portion thereof The acoustic command is received by the microphone 18 and provided to the signal processing module 16. The signal processing module 16 processes the acoustic command to detect whether it is an initiation command or a corresponding function command. Having detected the type of command, the signal processing module 16 processes the command accordingly to achieve the desired results.

Alternatively, or in addition to, the user may provide a gesture command 28. The gesture command may be a static gesture such as thumb up, thumb down, thumb sideways or a movement command such as waiving hand, moving the head and/or changing any physical position of the body, or portion thereof The gesture commands are sensed by the camera 20 and provided as digital video inputs to the signal processing module 16. The signal processing module 16 processes each gesture command to determine whether it is an initiation command or a corresponding function command. Having made such determination, the command is processed accordingly.

As one of average skill in the art will appreciate, the user of an entertainment device having a signal processing module 16 in accordance with the present invention may train the signal processing module 16 to recognize any variation of acoustic and/or gesture command. For example, the user may establish that the word "volume" is an initiation command to adjust the volume. The user may then establish that gesture commands of thumb up equates to increase volume, thumb down equates to decrease volume, and closed fist equates to mute. Of course, an almost endless combination of acoustic and gesture commands may be used to initiate functions. In addition, the gesture commands may be used independently or in conjunction with the acoustic commands to provide the particular input.

The signal processing module 16, while processing the gesture command and/or acoustic command, may provide a video and/or audio representation of the command to the display 14. Such information would be perceived as feedback 30 as to the particular command being processed. For example, if a gesture command is being received, the camera is programmed to zoom in on the particular movement (e.g., a hand movement), which would appear in a portion of the display as feedback 30. As such, the user would receive feedback as to proper interpretation of his or her gestures. In addition, the acoustic commands could be provided as audible feedback via the display, or converted to text information that is displayed via known voice to text techniques.

Figure 2:
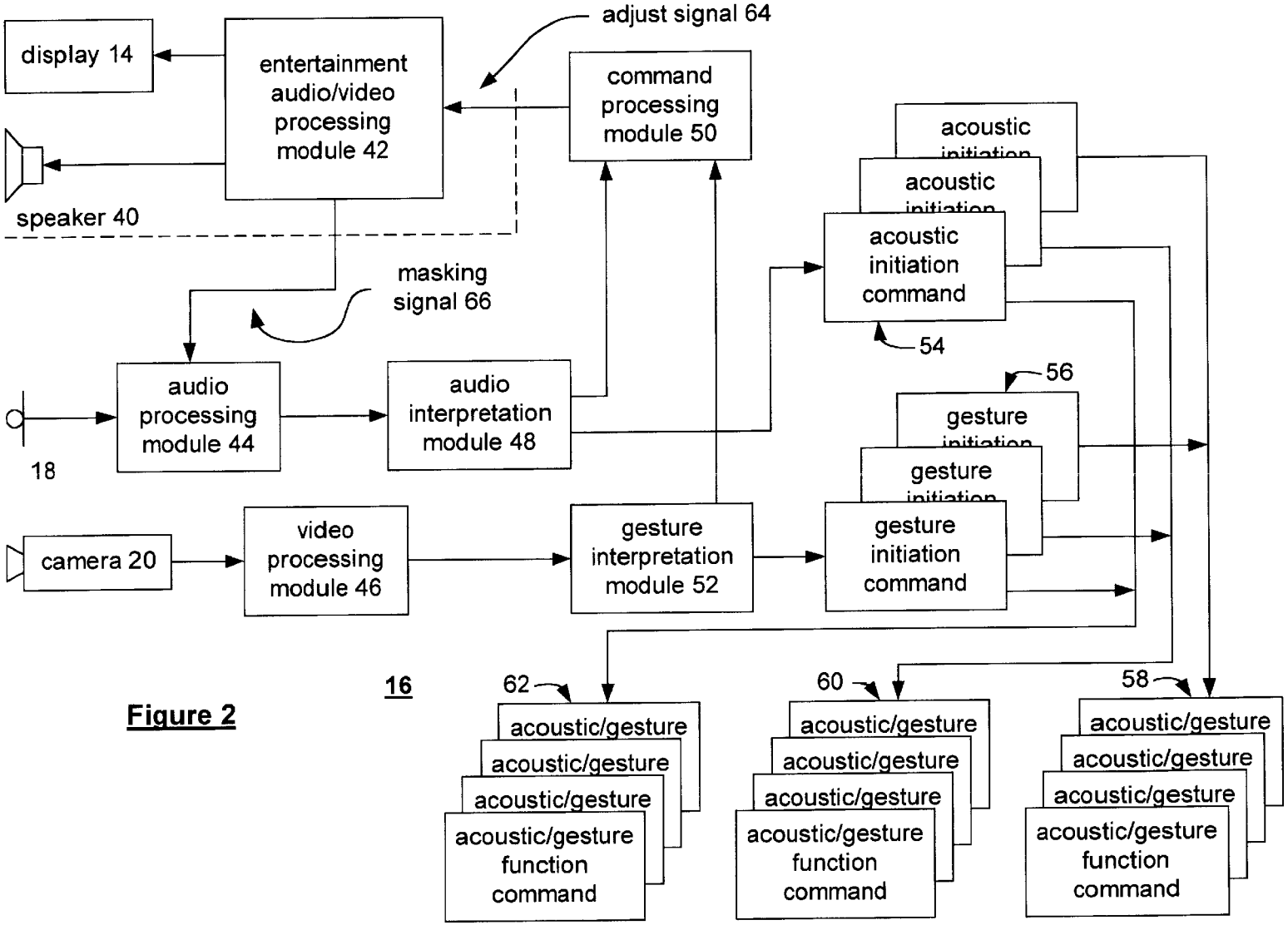
FIG. 2 illustrates a schematic block diagram of the signal processing module of the entertainment device of FIG. 1. in accordance with the present invention.

FIG. 2 illustrates a schematic block diagram of the signal processing module 16. The signal processing module 16 includes an audio processing module 44, an audio interpretation module 48, a command processing module 50, a video processing module 46, and a gesture interpretation module 52. In addition, the signal processing module 16 includes memory for storing analog or digital representations of acoustic initiation commands 54, analog and/or digital representations of gesture initiation commands 56, and for storing analog and/or digital representations of the acoustic and/or gesture function commands 58–62. Note that the modules 44 through 52 may be separate modules of processing module 22 or a single processing module of processing module 22.

In operation, acoustic commands are received via microphone 18 and provided to the audio processing module 44. The audio processing module 44 converts the acoustic command into digital signals, which are provided to the audio interpretation module 44. Note that the audio processing module 44 functions in a similar manner as an audio receiving module of a voice recognition system used in conjunction with computers.

The audio processing module 44 may be further coupled to receive a masking signal 66 from an entertainment audio/video processing module 42, which is part of the entertainment device 12. The entertainment audio/video processing module 42 generates video output signals that are provided to the display and audio output signals that are provided to speaker 40. While processing the audio portion of the signals, the entertainment audio/video processing module 42 generates an audio masking signal 66 which is provided to the audio processing module 44. In essence, the masking signal 66 is a representation of the audio being provided to speaker 40 such that the audio processing module 44 may cancel, or mask, the audio output speaker 40 from the acoustic commands via microphone 18. Note that the entertainment audio/video processing module 42 is of the type found in televisions, computers, VCRs, etc., to process video signals and to process audio signals. Further note that a masking signal 66 may be generated to cancel room, or background, noise using known techniques.

The audio interpretation module 48 is operably coupled to receive the representations of the acoustic commands from the audio processing module 44 and to compare them with a set of acoustic initiation commands 54 and a plurality of acoustic function commands 58–62. The comparison may be done in the analog domain by comparing waveforms or in the digital domain by comparing digital representations. When a substantial match occurs, the audio interpretation module 48 identifies the corresponding acoustic initiation command. Note that the matching process may include a level of error such that a best-guess matching technique is used. When a best-guess matching technique is used, it is advisable to use feedback to the user in conjunction with processing the signal to ensure that the appropriate command is interpreted and subsequently processed.

Having identified an initiation command, the audio interpretation module 48 and/or the gesture interpretation module 52 await a subsequent command corresponding to an acoustic and/or gesture function command. Once the function command is detected, it is provided to the processing module 50 for appropriate processing. Note that the gesture interpretation module 52 functions in a similar manner to that of the audio interpretation module 48. In particular, the gesture interpretation module compares digital representations of received gestures commands with stored digital representations of gesture initiation commands. The gesture interpretation module may be expanded to further process movement commands. When so programmed, the gesture interpretation module would compare subsequent frames of video data to determine the particular movement. Having interpreted the movement, the movement would be compared with a gesture initiation command and/or function command to identify the particular conmmand.

When the audio interpretation module 48 and/or the gesture interpretation module 52 identify a particular command, whether initiation or function, it may provide a signal to the command processing module 50. The command processing module 50 performs the particular function and provides an adjust signal 64 to the entertainment audio/video processing module 42. For initiation commands, the adjust signal 64 may include only information that is to be provided as feedback. Having identified a particular function command, the command processing module 52 provides a corresponding signal to the entertainment audio/video processing module 42 such that the entertainment device is adjusted accordingly.

As an example, assume that the entertainment device is a television and the entertainment audio/video processing module 42 corresponds to the circuitry within a television that provides the video output and audio output. When the microphone and/or camera detects an initiation command, a signal is provided to the command processing module 50 to provide feedback indicating the particular parameter that is to be adjusted. Thus, if the volume is to be adjusted, a corresponding acoustic and/or gesture initiation command is received via the microphone or camera Having detected this particular initiation command, the signal processing module 16 awaits to receive a separate acoustic and/or gesture function command. For example, the separate function command may be an acoustic command such as the words "increase volume", "decrease volume", "mute volume", "change the language", etc. or it may be a gesture command such as thumb up, thumb down, fist for mute, etc. The command processing module 50 interprets the particular function and provides the adjust signal 64 such that the volume is changed accordingly. Note that the command processing module 50 is as input command processing modules found in currently available entertainment devices as modified in accordance with the present invention.

Figure 3:
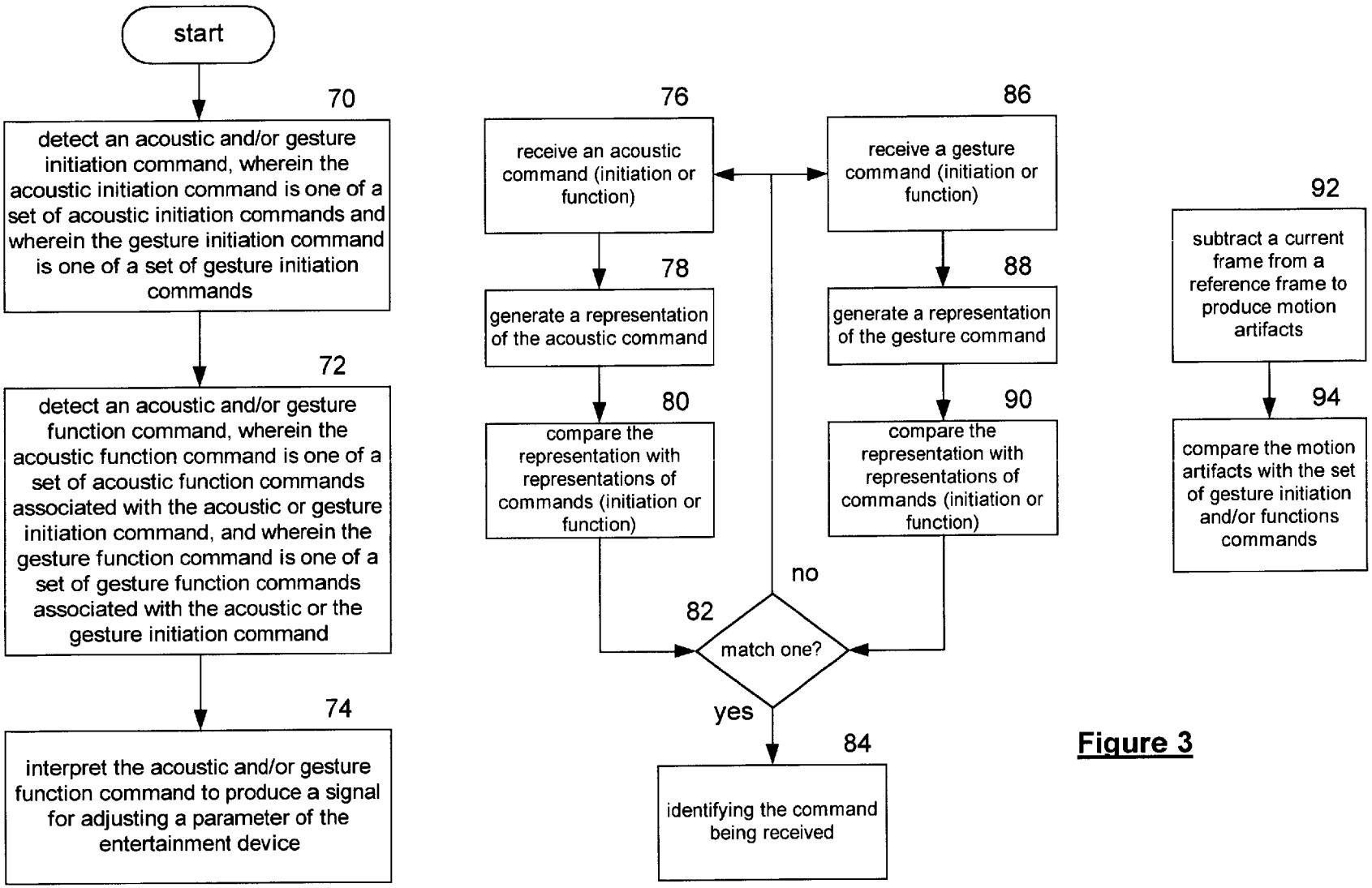
FIG. 3 illustrates a logic diagram of a method for processing acoustic and/or gesture input commands in accordance with the present invention.

FIG. 3 illustrates a logic diagram of a method for receiving an acoustic and/or a gesture input by an entertainment device. The process begins at step 70 where an acoustic and/or gesture initiation command is detected. The acoustic initiation command is one of a set of acoustic initiation commands and the gesture initiation command is one of a set of gesture initiation commands. Note that the set of gesture initiation commands may overlap with the set of acoustic initiation commands and/or that the set of gesture initiation commands may overlap with the set of acoustic initiation commands. For example, a volume adjust command may be initiated by an acoustic command, a gesture command, or a combination thereof Further note that the set of acoustic and gesture commands, whether initiation or function commands, may be newly defined. For example, a user that typically moves (e.g., wiggles foot) or is sitting in a rocking chair would not want such movement to be interpreted as a command. As such, the user would utilize gestures that are not part of his or her normal movements. Further note that the gesture commands include body movement, or a portion thereof, and/or body positioning or a portion thereof of body positioning. Still further note that the acoustic commands may correspond to acoustic waves made by a vibrating foot, a stomping foot and/or human audible noises (e.g., whistle, clap, etc).

The process then proceeds to step 72 where an acoustic and/or gesture function command is detected. Note that the acoustic function command is one of a set of acoustic function commands associated with the acoustic or gesture initiation command. Also note that a gesture function command is one of a set of gesture function commands associated with the acoustic or gesture initiation command. As such, an initiation command may be acoustic and/or gesture and the associated function command may be acoustic and/or gesture. The process then proceeds to step 74 where the acoustic and/or gesture function command is interpreted to produce a signal for adjusting a parameter (e.g., volume, picture settings, play, pause, etc.) of an entertainment device. Having generated this signal, it is provided to the entertainment device and processed accordingly. Part of the processing by the entertainment device may include providing feedback which is representative of the detected command and may be in the form of a text message, an audio message, and/or a video message.

FIG. 3 further shows the processing steps for detecting an acoustic command and for detecting a gesture command. The acoustic command detection begins at steps 76 where an acoustic command is received, where the acoustic command may be an initiation command or a function command. Having received the acoustic command, the process proceeds to step 78 where a representation of the acoustic command is generated. The representation in a preferred embodiment would be a digital representation that may be stored and subsequently digitally compared with stored representations of the known commands. Alternatively, an analog representation may be utilized.

The process then proceeds to step 80 where the representation of the acoustic command is compared with representations of known commands. The process then proceeds to step 82 where a determination is made as to whether the representation matches (which includes a best-guess matching process) one of the known acoustic representations. If not, the process repeats at step 76. If a match is detected, the process proceeds to step 84 where the command being received is identified as a particular initiation and/or function command.

The processing of gesture commands begins at step 86 where a gesture command is received. Note that the gesture command may be an initiation command or a function command. The process then proceeds to step 88 where a representation of the gesture command is generated. The representation may be a digital representation of a video captured gesture, a compressed version thereof and/or a series of frames of the gesture to indicate movement. The process then proceeds to step 90 where the representation of the received command is compared with stored representations of known commands. The process then proceeds to step 82 where a determination is made as to whether the received command matches (which includes a best-guess matching process) one of the stored commands. If not, the process repeats at step 86. If a match occurs, the process proceeds to step 84 where a command being received is identified. Note that a match may include a tolerance or an error term, that if the error term is less than a certain threshold, a match is assumed. When best-guess algorithms are employed, it is advisable to use feedback to the user to allow the user to verify the particular command before the command is executed.

FIG. 3 further illustrates at steps 92 and 94 how the video captured gestures are compared. Such processing begins at step 92 where a current frame of a gesture command is subtracted from a reference frame to produce motion artifacts. The motion artifacts are then compared at step 94 with a set of gesture initiation and/or function commands. As such, all of the differences, or motion, in successive frames are utilized to determine the particular gesture being offered by the user.

The preceding discussion has presented a method and apparatus for providing the user great flexibility in providing input commands to an entertainment device. By utilizing a combination of acoustic and/or gesture commands, the user may customize input commands to his or her preferences. As one of average skill in the art will readily appreciate, other embodiments of the present invention may be derived from the teachings of the present invention.

What is claimed is:

1. A method for receiving an input by an entertainment device, the method comprising the steps of:

detecting at least one of an acoustic initiation command and a gesture initiation command to produce a detected initiation command;

detecting at least one of an acoustic function command and a gesture function command to produce a detected function command, wherein the detected function command is associated with the detected initiation command;

masking acoustic output of the entertainment device that responds to the detected initiation command and detects function command, from at least one of the detected initiation command and the detection function command; and interpreting the detected function command to produce a signal for adjusting a parameter of the entertainment device.

2. The method of claim 1, wherein the step of detecting an acoustic initiation command comprises the steps of:

receiving an acoustic initiation command to produce a received acoustic initiation command;

generating a representation of the received acoustic initiation command;

comparing the representation with representations of a set of acoustic initiation commands; and when the representation substantially matches one of the representations of the set of acoustic initiation commands, identifying the received acoustic initiation command as one of the set of acoustic initiation commands.

3. The method of claim 1, wherein the step of detecting an acoustic function command comprises the steps of:

receiving an acoustic function command to produce a received acoustic function command;

generating a representation of the received acoustic function command;

comparing the representation with representations of a set of acoustic function commands; and when the representation substantially matches one of the representations of the set of acoustic function commands, identifying the received acoustic function command as one of the set of acoustic function commands.

4. The method of claim 1, wherein the step of detecting a gesture initiation command comprises the steps of:

receiving a gesture initiation command to produce a received gesture initiation command;

generating a representation of the received gesture initiation command;

comparing the representation with representations of a set of gesture initiation commands; and when the representation substantially matches one of the representations of the set of gesture initiation commands, identifying the received gesture initiation command as one of the set of gesture initiation commands.

5. The method of claim 1, wherein the step of detecting a gesture function command comprises the steps of:

receiving a gesture function command to produce a received gesture function command;

generating a representation of the received gesture function command;

comparing the representation with representations of a set of gesture function commands; and when the representation substantially matches one of the representations of the set of gesture function commands, identifying the received gesture function command as one of the set of gesture function commands.

6. The method of claim 1, wherein the acoustic initiation command is one of a set of acoustic initiation commands, wherein the acoustic function command is one of a set of acoustic function commands, wherein the gesture initiation command is one of a set of gesture initiation commands, wherein the gesture function command is one of a set of gesture function commands, and wherein the set of acoustic initiation commands, the set of acoustic function commands, the set of gesture initiation commands, and the set of gesture function commands are user defined.

7. The method of claim 1, wherein at least one of the gesture initiation command and the gesture function command includes body, or portion thereof, movement or body, or portion thereof, positioning.

8. The method of claim 7, wherein the body, or portion thereof, movement is detected by:

subtracting a current frame from a reference frame to produce motion artifacts;

focusing on the motion artifacts; and comparing the motion artifacts with a set of gesture initiation commands or with a set of gesture function commands.

9. The method of claim 1, wherein at least one of the acoustic initiation command and the acoustic function command comprises acoustic waves made by a vibrating foot, a stomping foot, or human audible sounds.

10. The method of claim 1, further comprises providing feedback on the entertainment device, wherein the feedback is representative of at least one of the detected initiation command and the detected function command, and wherein the feedback is at least one of a text message, an audio message, and a video message.

11. A signal processing module for use in an entertainment device, the signal processing module comprising:

a processing module; and memory operably coupled to the processing module, wherein the memory includes operational instructions that cause the processing module to:

detect at least one of an acoustic initiation command and a gesture initiation command to produce a detected initiation command;

detect at least one of an acoustic function command and a gesture function command to produce a detected flnction command, wherein the detected function command is associated with the detected initiation command;

mask acoustic output of the entertainment device that responds to the detected initiation command and detects flnction commands from at least one of the detected initiation command and the detected function command; and interpreting the detected function command to produce a signal for adjusting a parameter of the entertainment device.

12. The signal processing module of claim 11, wherein the memory further comprises operational instructions that cause the processing module to detect an acoustic initiation command by:

receiving an acoustic initiation command to produce a received acoustic initiation command;

generating a representation of the received acoustic initiation command;

comparing the representation with representations of a set of acoustic initiation commands; and when the representation substantially matches one of the representations of the set of acoustic initiation commands, identifying the received acoustic initiation command as one of the set of acoustic initiation commands.

13. The signal processing module of claim 11, wherein the memory further comprises operational instructions that cause the processing module to detect an acoustic function command by:

receiving an acoustic function command to produce a received acoustic function command;

generating a representation of the received acoustic function command;

comparing the representation with representations of a set of acoustic function commands; and when the representation substantially matches one of the representations of the set of acoustic function commands, identifying the received acoustic function command as one of the set of acoustic function commands.

14. The signal processing module of claim 11, wherein the memory further comprises operational instructions that cause the processing module to provide feedback on the entertainment device, wherein the feedback is representative of at least one of the detected initiation command and the detected function command, and wherein the feedback is at least one of a text message, an audio message, and a video message.

15. The signal processing module of claim 11, wherein the memory farther comprises operational instructions that cause the processing module to detect a gesture initiation command by:

receiving a gesture initiation command to produce a received gesture initiation command;

generating a representation of the received gesture initiation command;

comparing the representation with representations of a set of gesture initiation commands; and when the representation substantially matches one of the representations of the set of gesture initiation commands, identifying the received gesture initiation command as one of the set of gesture initiation commands.

16. The signal processing module of claim 11, wherein the memory further comprises operational instructions that cause the processing module to detect a gesture function command by:

receiving a gesture function command to produce a received gesture function command;

generating a representation of the received gesture function command;

comparing the representation with representations of a set of gesture function commands; and when the representation substantially matches one of the representations of the set of gesture function commands, identifying the received gesture function command as one of the set of gesture function commands.

17. The signal processing module of claim 11, wherein at least one of the gesture initiation command and the gesture function command includes body, or portion thereof, movement or body, or portion thereof, positioning.

18. The signal processing module of claim 17, wherein the memory further comprises operational instructions that cause the processing module to detect body, or portion thereof, movement by:

subtracting a current frame from a reference frame to produce motion artifacts;

focusing on the motion artifacts; and comparing the motion artifacts with a set of gesture initiation commands or with a set of gesture function commands.

* * * * *